United States Patent [19]

Nelson et al.

[11] 4,184,707

[45] Jan. 22, 1980

[54] BALL RETRIEVING AND STORAGE BAG

[76] Inventors: Ned H. Nelson, 9829 NE. 5th, Bellevue, Wash. 98004; Marvin L. Behar, 316 Main St., Edmonds, Wash. 98020

[21] Appl. No.: 900,887

[22] Filed: Apr. 28, 1978

[51] Int. Cl.[2] ..... A63B 57/00

[52] U.S. Cl. ..... 294/19 A

[58] Field of Search ..... 294/19 A, 19 R, 87 R, 294/87.27, 87.22, 87.24; 214/356; 53/328 R; 248/145.3, 145.6; 273/73 R

[56] References Cited

U.S. PATENT DOCUMENTS

| | | | |
|---|---|---|---|
| 3,926,465 | 12/1975 | Hoagland et al. | 294/19 A |
| 3,982,781 | 9/1976 | Tucker et al. | 294/19 A |

*Primary Examiner*—James B. Marbert

*Attorney, Agent, or Firm*—Thomas W. Secrest

[57] ABSTRACT

This invention is directed to an apparatus to assist in retrieving balls and in storing balls, such as tennis balls. The apparatus comprises a bottom frame through which a ball may pass upwardly when the bottom frame is positioned over the ball and pressed firmly to the ground and which frame prevents the ball passing downwardly and out of the frame by means of gravitational force. There is positioned above the frame a storage bag for storing balls.

15 Claims, 15 Drawing Figures

BALL RETRIEVING AND STORAGE BAG

The co-inventor, Ned H. Nelson, has two co-pending patent applications identified as follows: "A BALL RETRIEVING AND STORAGE BAG," filing date of Dec. 12, 1977, Ser. No. 859,383; and, "A BALL RETRIEVING AND STORAGE BAG," filing date of July 25, 1977, Ser. No. 818,975.

THE BACKGROUND OF THE INVENTION

This invention relates to an apparatus which allows a user of balls, such as tennis balls, to pick up numerous balls from the ground in one operation. Then the user can store and carry the balls in a convenient container without bending or stooping to pick up the balls by hand. As an illustration of the usefulness of this invention a tennis player wants to improve his serve by practicing, by himself, the serving of the tennis ball. The player goes to the tennis court and may serve ten or twenty or thirty tennis balls. There comes a time when the player must pickup the balls to once again practice the serve. It is inconvenient to the player, and also interrupts the concentration of the player, to bend over and pick up two or three balls and then serve these balls; and then repeat the process until all of the balls on one side of the net have been served over to the other side of the net. With this invention it is possible to pick up and store all of the balls at a location convenient to the player. There is a saving of time and there is a convenience to the tennis player as well as less frustration because the concentration of the tennis player is not interrupted.

At present, students and players of the game of tennis frequently use a large number of tennis balls when practicing and playing the game. A container is desirable to provide a means for collecting, storing and carrying a quantity of tennis balls. In addition to being useful on the tennis court the invention is useful in transporting the tennis balls and the tennis racket to and from the tennis court.

Another type of ball which may be picked up with this ball retrieving and storage bag apparatus is a golf ball.

A golfer may desire to practice putting or practice hitting the ball on approach to a green. The golfer may putt a number of balls such as ten or twenty or thirty balls. Or, the golfer may shoot a number of balls towards the green. After having practiced putting or hitting the ball toward the green the golfer approaches the green and, instead of bending over and picking up the balls and placing the balls in his pocket, can use this apparatus to pick up the balls and also to store the balls.

GENERAL DESCRIPTION OF THE INVENTION

This invention is a ball retrieving and storage apparatus comprising, in its preferred embodiment, a generally rigid assembly of varying lengths and standard pipe fittings of polyvinyl chloride pipe and two resilient plastic members. A moveable member is located in the open rectangular base frame of the apparatus with the distance between the moveable member and the frame being slightly less than the diameter of a ball to be retrieved. When the member and the base of the apparatus are placed over a ball or balls, and a downward force is exerted upon the handle of the apparatus, the member is moved, substantially, horizontally, to define an opening (with respect to the frame), approximately, equal to the diameter of the ball to be retrieved to admit the ball upwardly into the storage container portion of the apparatus. Also, the ball may be compressed to be able to pass between the member and the frame. The member may be resilient and flexible so as to allow the ball to deform it and to pass upwardly, between the member and the frame. After the passage of balls between the member and the frame, the member immediately resumes its original position and thereby prevents the balls from escaping through the generally open bottom frame of the apparatus by gravitational force. A length of cloth may be lashed to the rectangular periphery of the base and the cloth may extend upwardly from the base and around the vertical legs of the handle to define an enclosure for containing the balls within the apparatus. Straps may be placed around one or both of the vertical legs of the handle to secure tennis rackets thereto, providing a means of storing and carrying tennis rackets as well as tennis balls.

THE DRAWINGS

Figure 5:
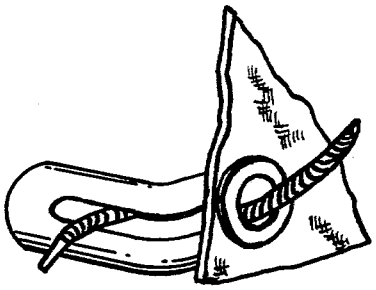
Figure 6:
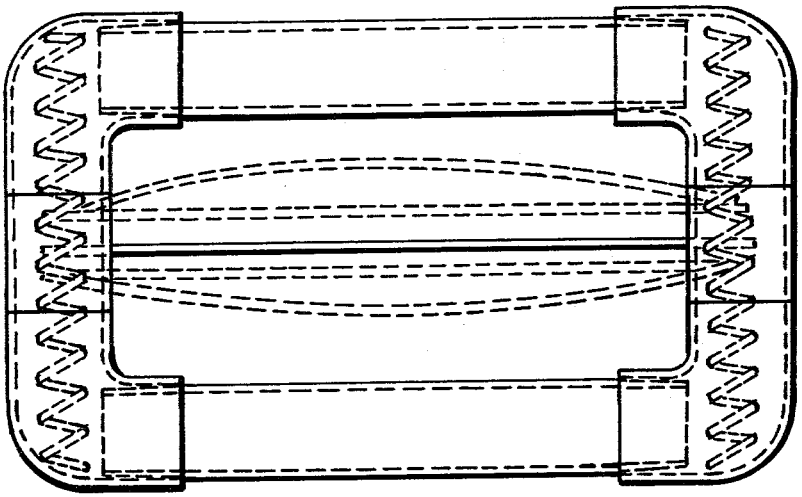
Figure 7:
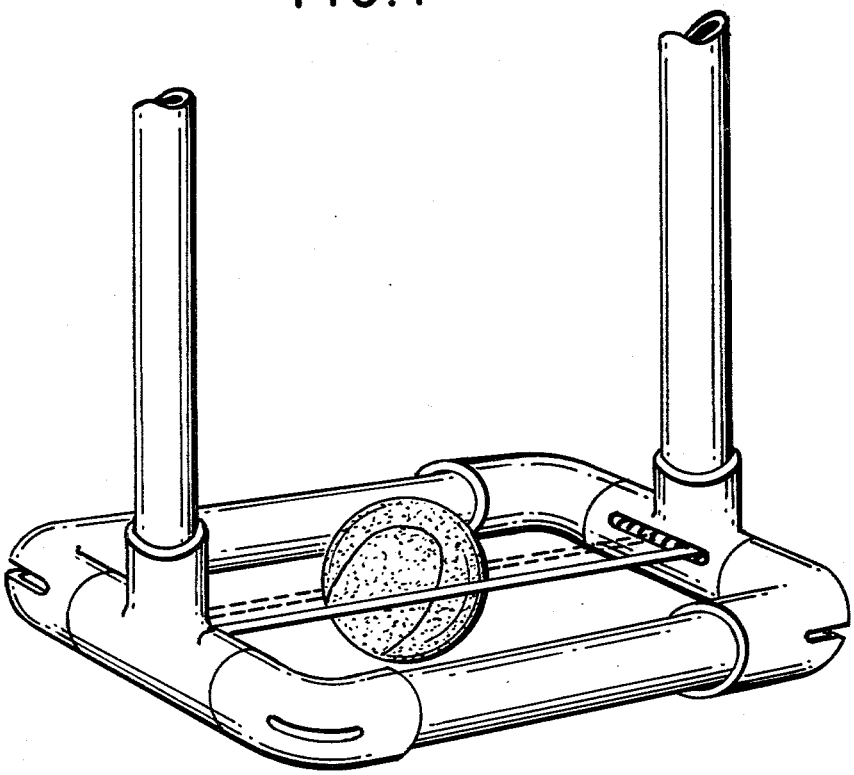
Figure 8:
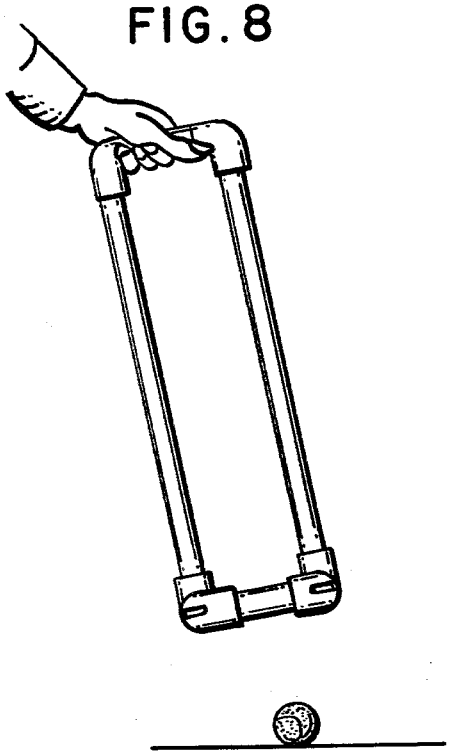
Figure 9:
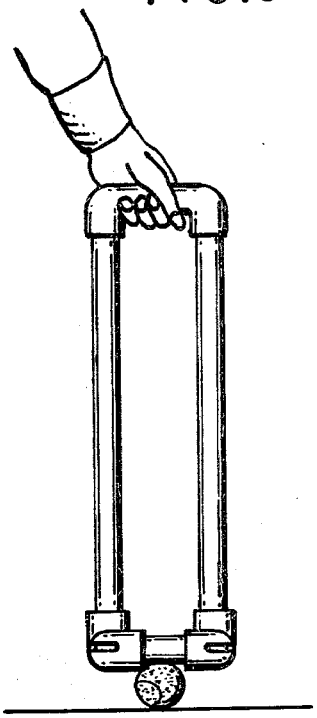
Figure 10:
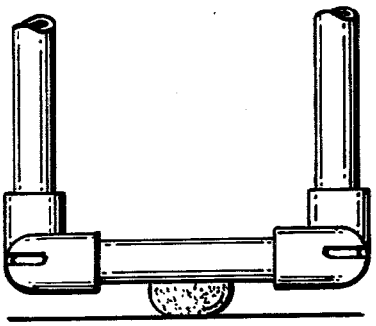
Figure 11:
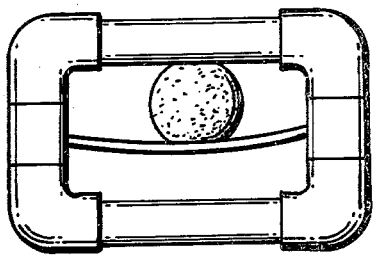
Figure 12:
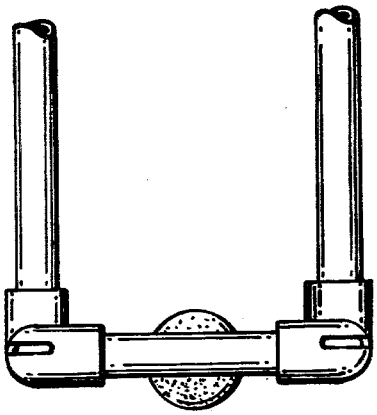
Figure 13:
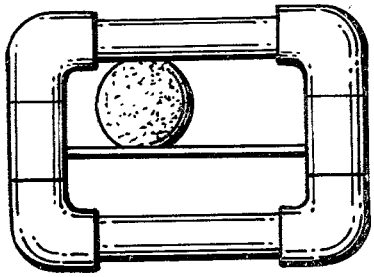
Figure 14:
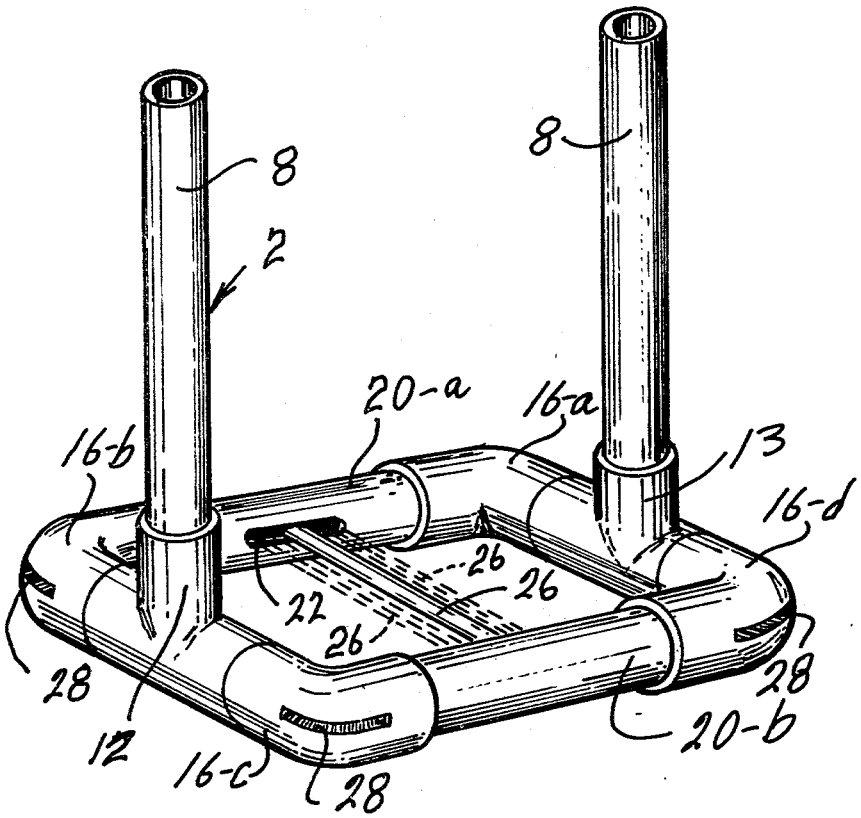
Figure 15:
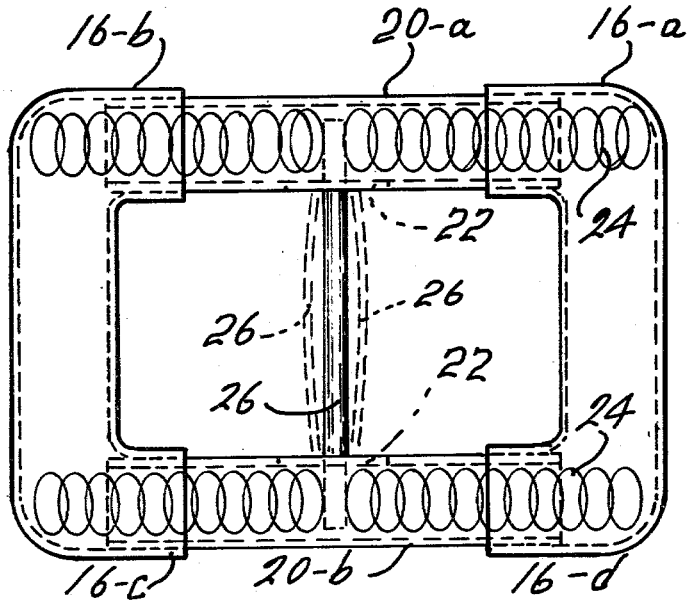

FIG. 5, on an enlarged scale, is a fragmentary, isometric view of a corner of the bottom frame of the invention and a fragmentary portion of the container fabric showing the manner of securing the container fabric to the periphery of the bottom frame or the base;

FIG. 6 is a plan view illustrating the frame and the two springs in the frame and the member in the frame and positioned by the two springs in the frame;

FIG. 7 is a fragmentary, isometric view illustrating the frame, the slots in the Tee's, and a ball passing between the moveable member and the side of the frame so as to pass into the storage area of the apparatus;

FIG. 8 is a view illustrating the moving of the apparatus with respect to the ball to be retrieved;

FIG. 9 is a side-elevational view illustrating the placing of the apparatus over the ball to be retrieved;

FIG. 10 on an enlarged scale, is a fragmentary, side-elevational view illustrating the placing of the apparatus over the ball and the forcing of the apparatus over the ball;

FIG. 11 is a plan view illustrating a ball moving the member in the frame and flexing the member in the frame and the ball being in the process of passing between the member and the frame;

FIG. 12 is a side-elevational view illustrating the ball passing between the member and the frame and being partially outside the frame and partially inside the frame; and, FIG. 13 is a plan view illustrating the ball with respect to the frame and showing the ball as having moved the member in the frame and also showing the ball as having substantially passed between the member and the frame;

FIG. 14 is a perspective view similiar to FIG. 7 and illustrates the flexible, moveable member positioned in slots in the long pipe as contrasted to FIG. 7 wherein the flexible, moveable member is positioned in slots in the Tees; and, FIG. 15 is a plan view illustrating the movement of the flexible member in the slot in the long pipe and, in phantom, the position of the flexible member after it has moved in the long pipes and also the bending and curving of the flexible member when the ball moves and deforms the flexible member.

THE DETAILED DESCRIPTION OF THE INVENTION

Figure 1:
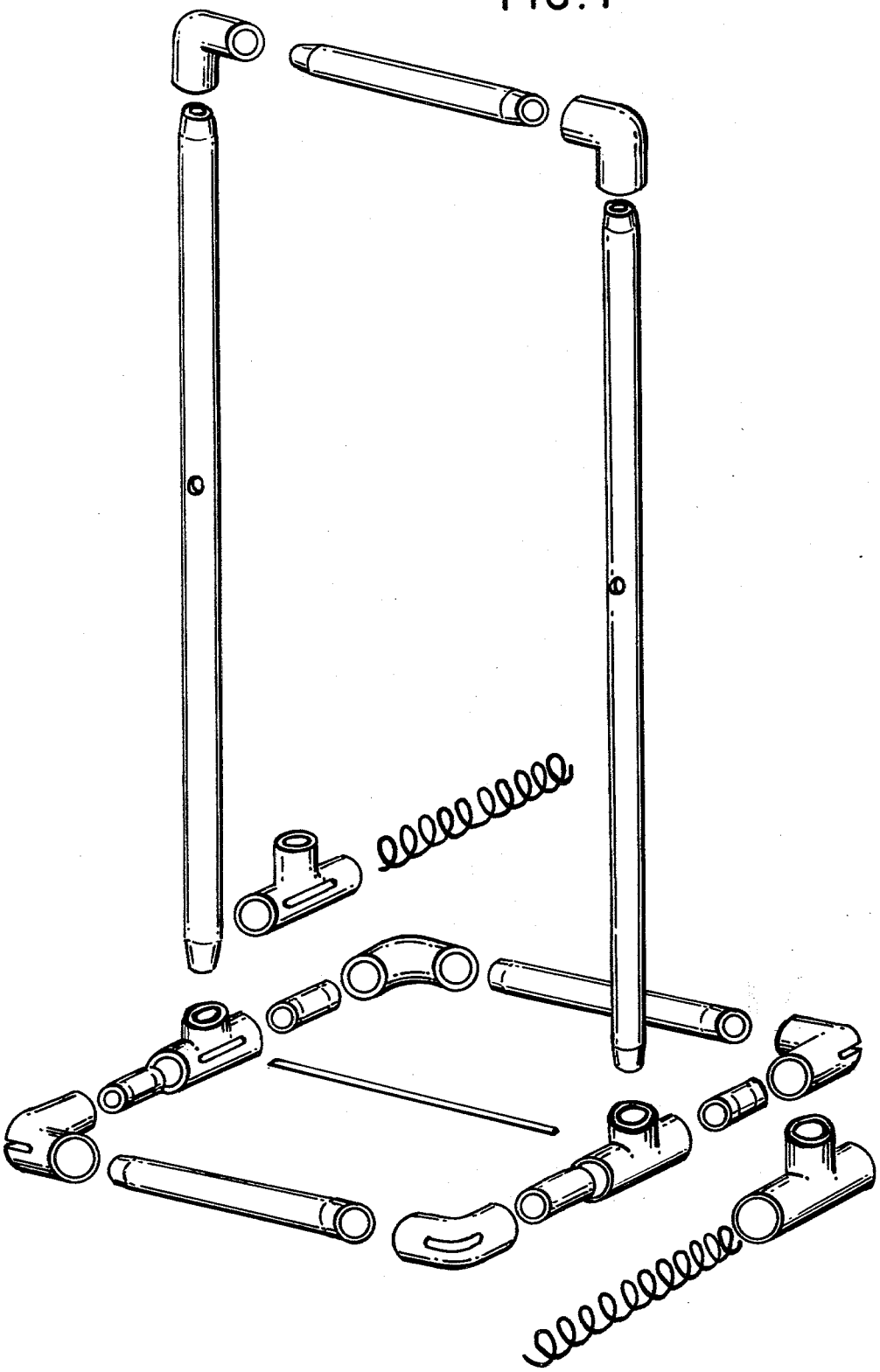
FIG. 1 is a isometric exploded view of the frame, upright legs and handle of the apparatus showing its components in disassembly, but in their relative positions for assembly.
Figure 2:
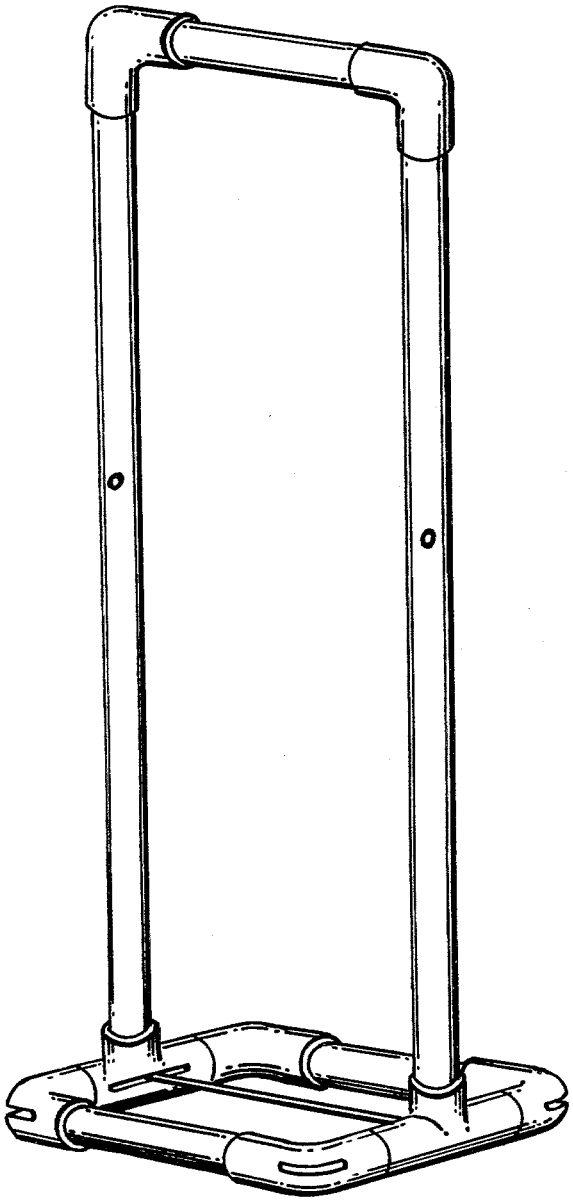
FIG. 2 is an isometric view of the frame, upright legs and handle of the apparatus in its assembled configuration.

In FIGS. 1 and 2, it is seen that a ball retrieval and storage apparatus 2 comprises a handle 4 connected by means of a pair of right angle elbows 6 to a pair of upright legs 8. The upright legs 8 are connected to the bottom frame 10 of the ball retrieval and storage apparatus 2 by means of a pair of Tees 12 and 13. The Tee 13 may be considered as a first Tee and the Tee 12 may be considered as a second Tee. Tees 12 and 13 are connected to a plurality of right angle elbows 16, viz, 16-*a*, 16-*c* and 16-*d*, by means of a plurality of nipples 14, viz, 14-*a*, 14-*b*, 14-*c* and 14-*d* by way of terminology a first elbow is 16-*a*; a second elbow is 16-*b*; a third elbow is 16-*c*; and, a fourth elbow is 16-*d*. Also, a first nipple is 14-*a*; a second nipple is 14-*b*; a third nipple is 14-*c*; and, a fourth nipple is 14-*d*. The sides 18 of the bottom frame 10 comprise a pair of long pipes 20, viz, 20-*a* and 20-*b*, a first long pipe is 20-*a* and a second long pipe is 20-*b*.

In the inner surface of each Tee there is a longitudinal slot 22. With the frame comprising the long pipes 20, the elbows 16, and the Tees in a horizontal position the slots 22 may be considered to be horizontal slots.

In the drawings it is seen that there is a spring 24 inside of the tubular members comprising associated Tee, two nipples and two right angle elbows. The spring 24 is used to center member 26 in the frame and between the long pipes 20.

It is seen also that the plurality of right angle elbows 16 each has a horizontal slot 28 in the outer wall of the right angle to receive and hold the container fabric lower lashing 30. It is further seen that each upright leg 8 is pierced by a hole 32 located near its med-length and through which hole is passed a container top lashing 34.

In FIG. 7 it is seen that a ball 38 is passing upwardly between the member 26 and a long pipe. The ball 38 is forcing the member 26 to move in the slot 22 so as to provide sufficient distance for the ball 38 to move between the long pipe 20 and the member 26 and into the apparatus 2.

Figure 3:
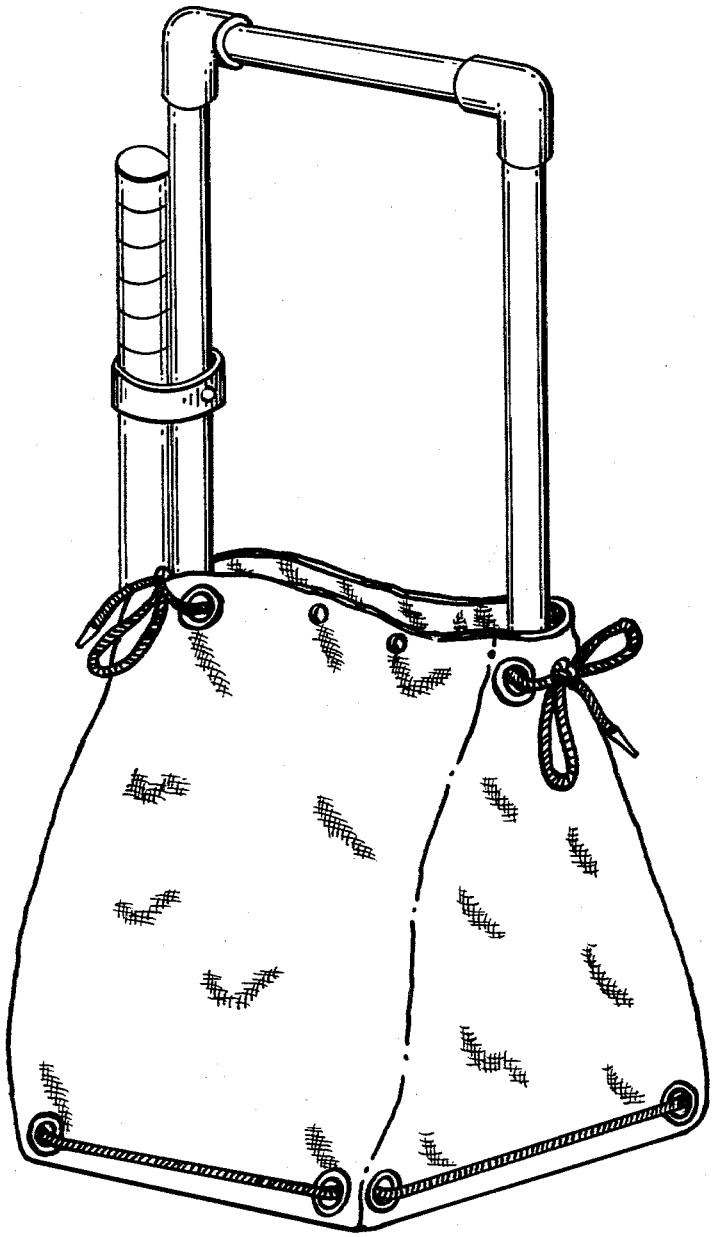
FIG. 3 is an isometric view of the assembled apparatus showing the cloth lashed to the periphery of the rectangular base and encompassing the upright legs to approximately their mid height, and also illustrating a tennis racket strapped to an upright leg.

In FIG. 3 it is seen that the container portion 36 of the ball retrieval and storage apparatus 2 comprises a length of fabric 40 having a plurality of eight grommets 39 at its lower corners to permit it to be lashed by means of the lashing 30 to the bottom frame 10. Also, at the upper corners there are four grommets 41 to permit the lashings 34 to attach the upper part of the fabric to the upright legs 8 of the ball retrieval and storage apparatus 2. The container fabric 40 may have a plurality of snap closures 42 located near its top 44 and along the upper edge.

A tennis racket 33 may be secured to an upright leg 8 for carrying with the storage apparatus 2 by a strap 9 attached to the upright leg 8 by a screw 37. The strap 9 encircles the upright leg 8 and the handle 35 of the tennis racket 33.

Figure 4:
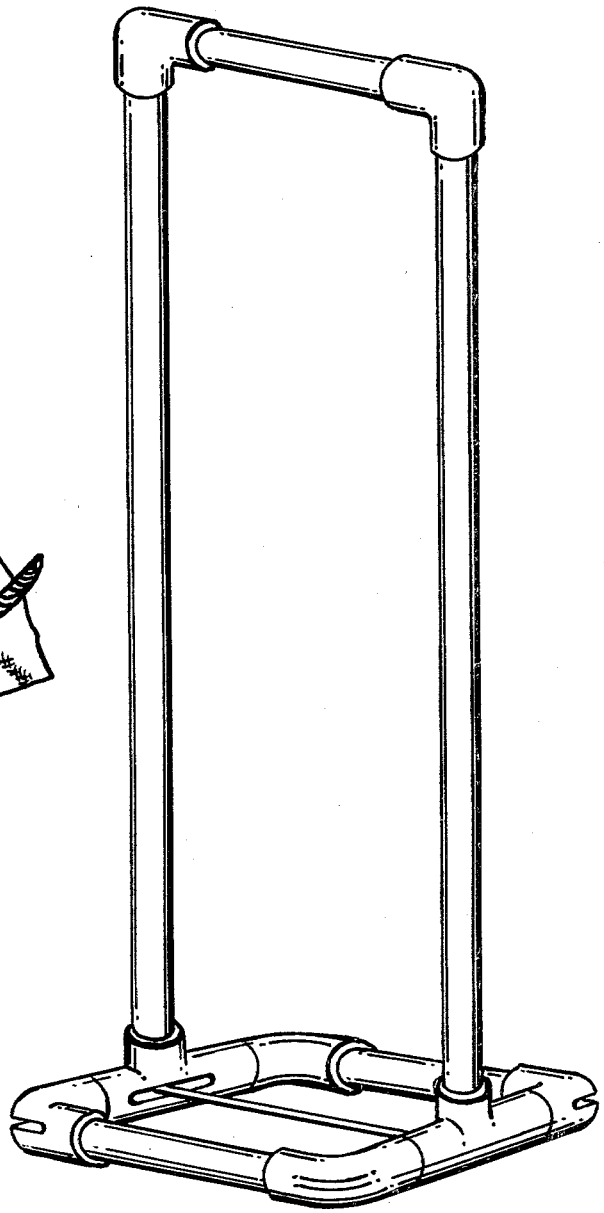
FIG. 4 is a fragmentary, isometric view of the invention having a portion of the upright part of the handle removed to illustrate, in insert, FIG. 5.

In FIG. 4 it is seen in detail the method of securing and retaining the storage container cloth 36 to the bottom frame elbow 16 by means of the lashing cord 30, the grommet 38 in the container cloth 36 and the slot 28 in the right angle elbow 16. It is seen that the lashing cord 30 fits into the slot 28, and when the cord 30 is pulled tight the cord 30 is firmly positioned in the slot 28.

FIG. 5 shows an alternative embodiment of the invention having a single upright leg 8 to which is attached the handle 4 by means of the right angle elbow 6. The unsupported end 46 of the handle 4 is enclosed by a cap 48. In FIG. 5 it is seen that there is a hole 32 in the upright leg 8 for receiving a lashing 34.

The use of the ball retrieval and storage apparatus is understood best by reference to FIG. 2 and FIGS. 8–13. The user places the bottom frame 10 of the ball retrieval and storage apparatus 2 over one or more balls 38 upon the ground. The space between the flexible member 26 and the bottom frame 10 is slightly less than the diameter of a ball 38. As the user exerts a downward force upon the handle 4 of the ball retrieval and storage apparatus 2, the flexible member 26 moves in the slots 22 and, may deflect momentarily and sufficiently to allow the ball 38 to slip between the flexible member 26 and the bottom frame 10 to pass upward into the storage area 36 defined by the fabric 40 shown in FIG. 3. After passage of the ball 38 into the storage container 36, the flexible member 26 assumes its former configuration and is moved by springs 24 to be equidistant between the two parallel, spaced-apart long pipes 20. With the member 26 in its original position the balls 38 are prevented, by force of gravity, from slipping downwardly through the bottom frame 10.

In FIGS. 1 and 6 there is illustrated the spring 24 and which spring 24 is positioned inside of the Tees, the nipples attach to the Tees and the right angle elbows attach to the nipple. It is seen that the spring 24 assists in positioning the flexible member 26 in the slots 22 in the Tees. The member 26 is flexible, resilient, adaptable and deformable. In FIG. 6 this is illustrated by phantom line wherein it is seen that member 26 has been deformed. Also, in FIG. 6 it is seen, in phantom line, that the member 26 is moveable in the slots 22 in the Tees.

In FIG. 8 there is a view illustrating a person maneuvering the apparatus so as to be over the ball with the ball resting on the ground 50 such as the green on a golf course or the playing surface on a tennis court.

Then, in FIG. 9 there is illustrated a person positioning the frame of the apparatus directly over the ball on the ground.

In FIG. 10 there is illustrated the frame being positioned over the ball and squeezing the ball on the ground 50. FIG. 11 illustrates the ball moving the member 26 in the slot 22 in the frame and also deforming the member 26 so as to allow the ball to pass between the member 26 and the frame.

In FIG. 12 there is illustrated, in a side-elevational view, the ball as being partially within the apparatus and partially out of the apparatus.

In FIG. 13 there is illustrated the ball as being positioned between the flexible member 26 and the long pipe 20 and with the ball having moved the flexible member a short distance in the slot 22.

It is to be understood that the slots 22 can be in the long pipe 20 and not in the Tees. This is illustrated in FIG. 14. FIG. 14 is similiar to FIG. 7 except that the slots 22 are in the long pipe 20 and not in the Tees. Also, in FIG. 14 it is seen that the ball is moving between the flexible member 26 and the Tees and has moved the flexible member 26 in the slots 22 in the long pipe.

In FIG. 15 it is seen that the flexible member 26 is in the long pipe 20 and, in phantom line, has moved in the slots 22 in the long pipe 20. Also, in FIG. 6 it is seen that the flexible member 26, in phantom, has been deformed.

It is to be understood that in the drawings that for ease of illustration in FIGS. 6–15 that the fabric has been removed from the frame for ease of illustration of the movement of the member 26 in the frame and for the passing of the ball between the member 26 and the frame.

The distance between the center of the flexible rods 26 and the surface on which bottom frame 10 rests is less than the radius of the ball so that the ball can be forced through the bottom frame and into the container.

Again, this ball retrieving storage bag apparatus too may be used for picking up a number of balls such as a tennis ball, a golf ball and the like. It is conceivable that an older person may want to gather fruit such as apples have fallen on the ground and can use this apparatus for picking up the apples off of the ground.

We consider that this invention is new as we have not seen a ball retrieving and storing apparatus wherein the flexible member moves horizontally or in a longitudinal movement in the members of the frame. This horizontal or longitudinal movement of the members in the frame makes it possible for the member and the frame to accommodate themselves to objects which are larger than the normal distance between the member and the frame. After the object, such as a tennis ball or a golf ball or an apple or a rock, has passed into the apparatus then the flexible member, because of the spring 24, moves in the slot 22 so that the distance between the flexible member 26 and the frame is less than the dimension or diameter of the object.

We consider the invention to be useful as it makes it possible for many people to pick up objects such as a tennis ball or a golf ball or an apple or a rock without having to bend over. Some people may like to pick up these objects but, due to back problems or other disabilities, may find it difficult to pick up the object and therefore do not engage in such an activity. With this apparatus it is possible to, easily, pick up the object and store the object in the apparatus.

We consider this invention to be unobvious in view of the art as we know the art because we do not know of any other apparatus for picking up these objects wherein the flexible member 26 moves horizontally or longitudinally in the slot 22 in the frame.

We did not make a patent search in preparing this patent application.

Some patents have come to our attention. These are:

| U.S. Pat. No. | Inventor |
|---|---|
| 2,384,794 | E. T. Buckley Et Al |
| 3,371,950 | J. Stap |
| 3,926,465 | Hoagland Et Al |

| English Patent No. | Inventor |
|---|---|
| 24,322 | Hammond Et Al of 1901 |

-continued

| English Patent No. | Inventor |
|---|---|
| 752,644 | Litton |

One of the co-inventors, NED H. NELSON, has filed a utility patent application, Ser. No. 859,383, filing date of Dec. 12, 1977, entitled "BALL RETRIEVING AND STORAGE BAG," and a design application, Ser. No. 818,975, filing date of July 25, 1977, entitled "BALL RETRIEVING AND STORAGE BAG."

From the foregoing and having presented our invention what we claim is:

1. An apparatus for retrieving and storing a ball, said apparatus comprising:

a. a base comprising a frame;
b. said frame comprising a first tube and a second tube;
c. said first tube and said second tube being spaced apart;
d. a first slot in said first tube;
e. a second slot in said second tube;
f. a first resilient means in said first tube;
g. a second resilient means in said second tube;
h. a member in said frame;
i. said member having a first end in said first slot in said first tube and, operatively, connecting with said first resilient means;
j. said member having a second end in said second slot in said second tube and, operatively, connecting with said second resilient means;
k. said member being moveably positioned in said frame;
l. the dimension between said frame and said members, normally being less than the diameter of a ball to prevent the ball being pulled through said base by gravity;
m. said frame may be positioned over said ball and then forced over said ball so as to move said member in said frame to allow said ball to move between said member and said frame and into said apparatus;
n. an enclosing means positioned above said frame and for storing said ball; and,
o. a handle connecting with said frame.

2. An apparatus according to claim 1 for retrieving and storing a ball, said apparatus comprising:

a. said member being flexible, resilient, adaptable and deformable to allow said ball to pass between said member and said frame.

3. An apparatus according to claim 1 for retrieving and storing a ball, said apparatus comprising:

a. the distance between said member and the surface on which the ball rests being less than the radius of the ball.

4. An apparatus according to claim 1 for retrieving and storing a ball, said apparatus comprising:

a. said member being positioned in frame and being rotatable in said frame.

5. An apparatus according to claim 1 for retrieving and storing a ball, said apparatus comprising:

a. said frame circumscribing an opening.

6. An apparatus according to claim 1 for retrieving and storing a ball, said apparatus comprising:

a. said first tube and said second tube spaced apart; and, b. said first slot and said second slot being aligned to receive said member.

7. An apparatus according to claim 1 and comprising:

a. said handle comprising an upright leg attached to said frame; and, b. a handle member connecting with said upright leg so that a person can grip said handle member to maneuver said apparatus for picking up and storing said balls.

8. An apparatus for retrieving and storing a ball, said apparatus comprising:

a. a base comprising a frame;

b. said frame comprising a first tube and a second tube;

c. said first tube and said second tube being spaced apart;

d. a first slot in said first tube;

e. a second slot in said second tube;

f. a first resilient means in said first tube;

g. a second resilient means in said second tube;

h. a member in said frame;

i. said member having a first end in said first slot in said first tube and, operatively, connecting with said first resilient means;

j. said member having a second end in said second slot in said second tube and, operatively, connecting with said second resilient means;

k. said member being moveably positioned in said frame;

l. the dimension between said frame and said members, normally being less than the diameter of a ball to prevent the ball being pulled through said base by gravity;

m. said frame may be positioned over said ball and then forced over said ball so as to move said member in said frame to allow said ball to move between said member and said frame and into said apparatus;

n. an enclosing means positioned above said frame and for storing said ball;

o. a handle connecting with said frame;

p. said first tube and said second tube spaced apart;

q. said first slot and said second slot being aligned to receive said member;

r. two spaced apart aligned slots in said frame;

s. said member being in said two slots;

t. said member being moveably positioned in said slots in said frame;

u. a resilient means associated with said frame and said slots and for positioning said member in said slots;

v. said member being flexible, resilient, adaptable and deformable to allow said ball to pass between said member and said frame;

w. said member being positioned in said frame and being rotatable in said frame; and, x. the distance between said member and the surface on which the ball rests being less than the radius of the ball.

9. An apparatus for retrieving and storing a ball, said apparatus comprising:

a. a base comprising a frame;

b. a member in said frame;

c. said member being moveably positioned in said frame;

d. the dimension between said frame and said members, normally being less than the diameter of a ball to prevent the ball being pulled through said base by gravity;

e. said frame may be positioned over said ball and then forced over said ball so as to move said member in said frame to allow said ball to move between said member and said frame and into said apparatus;

f. an enclosing means positioned above said frame and for storing said ball;

g. a handle connecting with said frame;

h. said frame comprising a first, second, third and fourth right angle elbow, a first and a second Tee, a first and a second long pipe, a first, second, third and fourth nipple;

i. said first right angle elbow connecting with said first long pipe and said first long pipe connecting with said second right angle elbow and said second right angle elbow connecting with said first nipple and said first nipple connecting with said first Tee and said first Tee connecting with said second nipple and said second nipple connecting with said third right angle elbow and said third right angle elbow connecting with said second long pipe and said second long pipe connecting with said fourth right angle elbow and said fourth right angle elbow connecting with said third nipple and said third nipple connecting with said second Tee and said second Tee connecting with said fourth nipple and said fourth nipple connecting with said first right angle elbow to form a frame enclosing an open area;

j. a slot in said frame;

k. part of said member in said slot and part of said member positioned in another part of said frame; and, l. said member being moveably positioned in said frame.

10. An apparatus according to claim 9 and comprising:

a. a resilient means associated with said frame and said slot and for positioning said member in said slot.

11. An apparatus according to claim 9 and comprising:

a. each of said first, second, third and fourth right angle elbows in said frame having an exterior slot;

b. said enclosing means comprising a fastening means for fitting in each of said slots in said right angle elbow;

c. a passageway in each of said upright legs; and, d. a means connecting said enclosing means to said passageway and to each of said upright legs to form a bag for retaining said balls.

12. An apparatus according to claim 11 and comprising:

a. said handle comprising an upright leg attached to said frame; and, b. a handle member connecting with said upright leg so that a person can grip said handle member to maneuver said apparatus for picking up and storing said balls.

13. A method for assembling an apparatus for retrieving and storing a ball, said method comprising:

a. assembling a plurality of tubular plastic plumbing pieces to form a frame comprising right angle elbows, and a Tee to form a frame;

b. positioning a moveable member in said frame with the distance between said member and the closest side of said frame being somewhat less than the diameter of said ball;

c. positioning an upright leg on said Tee;

d. on the upper part of said upright leg positioning a right angle elbow;

e. positioning a pipe in said upright elbow to function as a handle; and, f. positioning an enclosing means on said upright leg and said frame to store the ball.

14. A method for assembling an apparatus according to claim 13 and comprising:

a. in assembling said frame assembling a first tube and a second tube in a speced apart relation;

b. said first tube having a first slot;

c. said second tube having a second slot;

d. positioning a first resilient means in said first tube;

e. positioning a second resilient means in said second tube;

f. positioning a member in said frame with a first end in said first slot and a second end in said second slot; and, g. said member operatively connecting with said first resilient means and said second resilient means.

15. A method for assembling an apparatus according to claim 14, and comprising:

a. said first resilient means being a spring; and, b. said second resilient means being a spring.

* * * * *